US006109622A

United States Patent [19]

Reynolds

[11] Patent Number: 6,109,622

[45] Date of Patent: Aug. 29, 2000

[54] ICE SKATE CHASSIS AND BLADE HOLDER ASSEMBLY

[75] Inventor: Alexander P. Reynolds, Balboa, Calif.

[73] Assignee: Mission Hockey Company, Santa Ana, Calif.

[21] Appl. No.: 09/146,836

[22] Filed: Sep. 3, 1998

Related U.S. Application Data

[60] Provisional application No. 60/078,854, Mar. 20, 1998.

[51] Int. Cl.[7] ..... A63C 1/30

[52] U.S. Cl. ..... 280/11.17; 280/11.18

[58] Field of Search ..... 280/600, 11.17, 280/11.18, 841, 11.12, 11.16; 36/115

[56] References Cited

U.S. PATENT DOCUMENTS

| | | |
|---|---|---|
| 115,487 | 5/1871 | Lank . |
| D. 305,560 | 1/1990 | Hoshizaki et al. . |
| D. 371,672 | 7/1996 | Hoshizaki et al. . |
| 1,904,270 | 4/1933 | Charette . |
| 1,977,587 | 10/1934 | MacDonnell . |
| 2,096,677 | 10/1937 | Fassett . |
| 2,206,397 | 7/1940 | Goldenberg . |
| 4,492,385 | 1/1985 | Olson . |
| 4,509,276 | 4/1985 | Bourque . |
| 4,655,465 | 4/1987 | Schaeffer . |
| 4,835,885 | 6/1989 | Hoshizaki et al. . |
| 5,484,148 | 1/1996 | Olivieri . |
| 5,505,470 | 4/1996 | Hoshizaki . |
| 5,641,169 | 6/1997 | Bekessy . |
| 5,971,405 | 10/1999 | Edauw ..... 280/11.14 |

FOREIGN PATENT DOCUMENTS 0 427 920 A1 5/1991 European Pat. Off. .

OTHER PUBLICATIONS

Advertisement from Hockey Business News, Oct. 1997, vol. 3; No. 7. entitled Anatomy of Perfection by CCM The Hockey Company.

*Primary Examiner*—Michael Mar
*Attorney, Agent, or Firm*—Knobbe, Martens, Olson & Bear, LLP

[57] ABSTRACT

A skate blade holder assembly for an ice skate has a substantially rigid reinforcement member extending longitudinally from a front mounting portion to a rear mounting portion of the skate blade holder assembly. The substantially rigid reinforcement member complements a neck portion of the skate blade holder, thereby forming a closed load-bearing frame or truss which greatly increases the rigidity and strength of the skate blade holder assembly. This increased rigidity of the skate blade holder assembly increases the durability of the skate blade, and promotes faster and more efficient force transfer between the skater and the ice. A redundant connector located adjacent the midpoint of the skate blade secures the skate blade to the supporting side walls of the longitudinal slot, thereby further increasing the rigidity of the skate blade and preventing and/or limiting warpage of the skate blade under extreme loading conditions.

21 Claims, 5 Drawing Sheets

ICE SKATE CHASSIS AND BLADE HOLDER ASSEMBLY

This application claims benefit of Provisonal Appl. No. 60/078,854 filed Mar. 20, 1998.

BACKGROUND OF THE INVENTION

This invention relates to ice skates and in particular to an improved ice skate blade holder assembly.

In conventional ice skate blade holder assemblies, a blade holder is secured to the skate boot and has a longitudinal slot into which the replaceable blade or "runner" is installed. The blade holder is typically attached to or formed integrally with heel and toe portions that attach to the underside of the skate boot.

This type of blade holder assembly has been extremely successful, particularly because the blade can be easily removed and replaced without replacing the entire blade holder assembly. However, maintaining rigidity along the central portion of the blade and blade holder (i.e., along the neck portion between the heel and toe portions) is often difficult due to the construction of the blade holder assembly itself, particularly for large and/or heavy individuals. Greater rigidity of the blade holder assembly would tend to reduce the stress in the neck portion of the blade holder. This is desirable because the plastic of the blade holder assembly can sometimes become brittle and fracture under excessive stress. In addition, greater rigidity of the blade holder assembly would decrease the tendency of the blade to warp under increased loading conditions.

One means of increasing the rigidity of the blade holder assembly is to incorporate a reinforcing strip in the neck portion of the plastic blade holder. See e.g., U.S. Pat. No. 5,484,148 to Olivieri. The '148 patent discloses a longitudinally extending reinforcing composite-plastic or metal strip disposed within the neck portion of the blade holder. The reinforcing strip is intended to strengthen and stiffen the neck portion, thereby reducing stresses experienced by the plastic blade holder. According to the '148 patent, the resulting greater rigidity of the blade holder provides for better force transfer between the ice and the skate boot, via the attachments between the skate boot and the front and rear portions of the blade holder assembly.

However, the reinforced blade holder assembly of the '148 patent still has insufficient rigidity for some applications, such as aggressive skating, particularly for large and/or heavy individuals. It also suffers from other significant disadvantages due to the increase in the cross-sectional area and weight of the blade holder resulting from incorporation of the internal reinforcing strip.

In standard skate blade sharpening machines, the arms containing the sharpening/grinding surfaces are located very close to each other, and clearance between these arms is extremely limited. In order to sharpen a skate blade installed in a skate blade assembly, the skate blade assembly must be sufficiently narrow to fit into the confined arm space so that the skate blade will contact the sharpening/grinding surfaces. If the skate blade assembly does not fit, the skate blade must be (1) sharpened manually; (2) removed from the skate blade assembly, sharpened and then reattached to the skate blade assembly; or (3) sharpened on a specially constructed sharpening machine.

In the case of a reinforced blade holder constructed according to the disclosure of the '148 patent, the increased width of the blade holder will not fit into many standard sharpening machines. An individual seeking to sharpen such a skate blade must therefore expend additional time and effort in sharpening the skate, or must purchase a sharpening machine specially constructed to accommodate such a reinforced blade holder assembly.

Furthermore, the reinforcing of the skate blade assembly as disclosed in the '148 patent adds substantial weight. As disclosed in the '148 patent, the reinforcing strip is approximately one-half the size of the skate blade. Even if this strip were composed of a composite-plastic, it would add significant weight to the skate blade assembly. Where the strip is made of metal, as suggested in the '148 patent, the increase in skate weight would be substantial. The '148 patent recognizes that additional skate weight may be a drawback of adding the disclosed reinforcing member. To compensate for the increased weight, the '148 patent suggests removing wedges of material from the skate blade assembly and the skate blade itself. This would significantly increase the complexity and expense of manufacturing such a reinforced skate blade assembly and may reduce the integrity of the blade.

Accordingly, there remains a need in the art for a skate blade assembly having increased torsional and longitudinal rigidity without significant increases in weight and/or manufacturing complexity of the skate blade assembly. In addition, there is a need for such a skate blade assembly in which the skate blade may be easily and conveniently sharpened using standard skate sharpening equipment.

SUMMARY OF THE INVENTION

The present invention provides a substantially rigid reinforcement member or "drive shaft" extending generally longitudinally between the forward and rear attachment portions of the blade holder assembly, thereby increasing rigidity, reducing stress and improving force transfer between the skater and the ice.

More particularly, the skate blade holder assembly of the present invention has an elongated blade holder having a front mounting portion for attachment beneath the toe area of the skate boot, a rear mounting portion for attachment beneath the heel area of the skate boot, and an integral "neck" bridging the front and rear portions. The blade holder has a longitudinal slot running along the bottom thereof to receive a blade or "runner," which is secured at least partially within the slot. Spaced apart from the neck, at least one substantially rigid tubular reinforcement member provides a truss reinforcement from the front mounting portion to the rear mounting portion. Preferably, the reinforcement member is constructed of a reinforced plastic composite material, although a metal or other material could also be used. This reinforcement member serves to inhibit the front portion from flexing and/or significantly moving relative to the rear portion, and vice versa, thereby increasing both the longitudinal and torsional rigidity of the blade holder assembly, resulting in a light-weight blade holder assembly which is less susceptible to warpage under various heavy load conditions.

Accordingly, because the skate blade assembly of the present invention substantially resists longitudinal and torsional deformation, a greater proportion of the power generated by the skater will be transferred directly to the skate blade and the ice, rather than being absorbed or diverted by flexure of the skate blade assembly. Not only does this increase the total power transfer from the skater's foot to the ice, allowing more efficient and effective skating, but it also provides for faster, more efficient power transfer, allowing the skater to speed up, slow down and/or maneuver much more quickly than with a conventional skate blade assembly.

In addition, by utilizing front, central and rear attachment points to secure the skate blade to the skate blade assembly, the skate blade is less likely to plastically deform and/or twist under increased load conditions, which significantly extends the life of the skate blade when compared to a skate blade in a conventional skate blade assembly.

Further features and advantages of the invention will be described or will become apparent in the course of the following detailed description and from an examination of the accompanying drawings.

BRIEF DESCRIPTION OF THE DRAWINGS

The invention will be better understood from the ensuing detailed description and the accompanying drawings of the preferred embodiment, which are provided by way of example only, of which.

DETAILED DESCRIPTION OF THE PREFERRED EMBODIMENT

Figure 1:
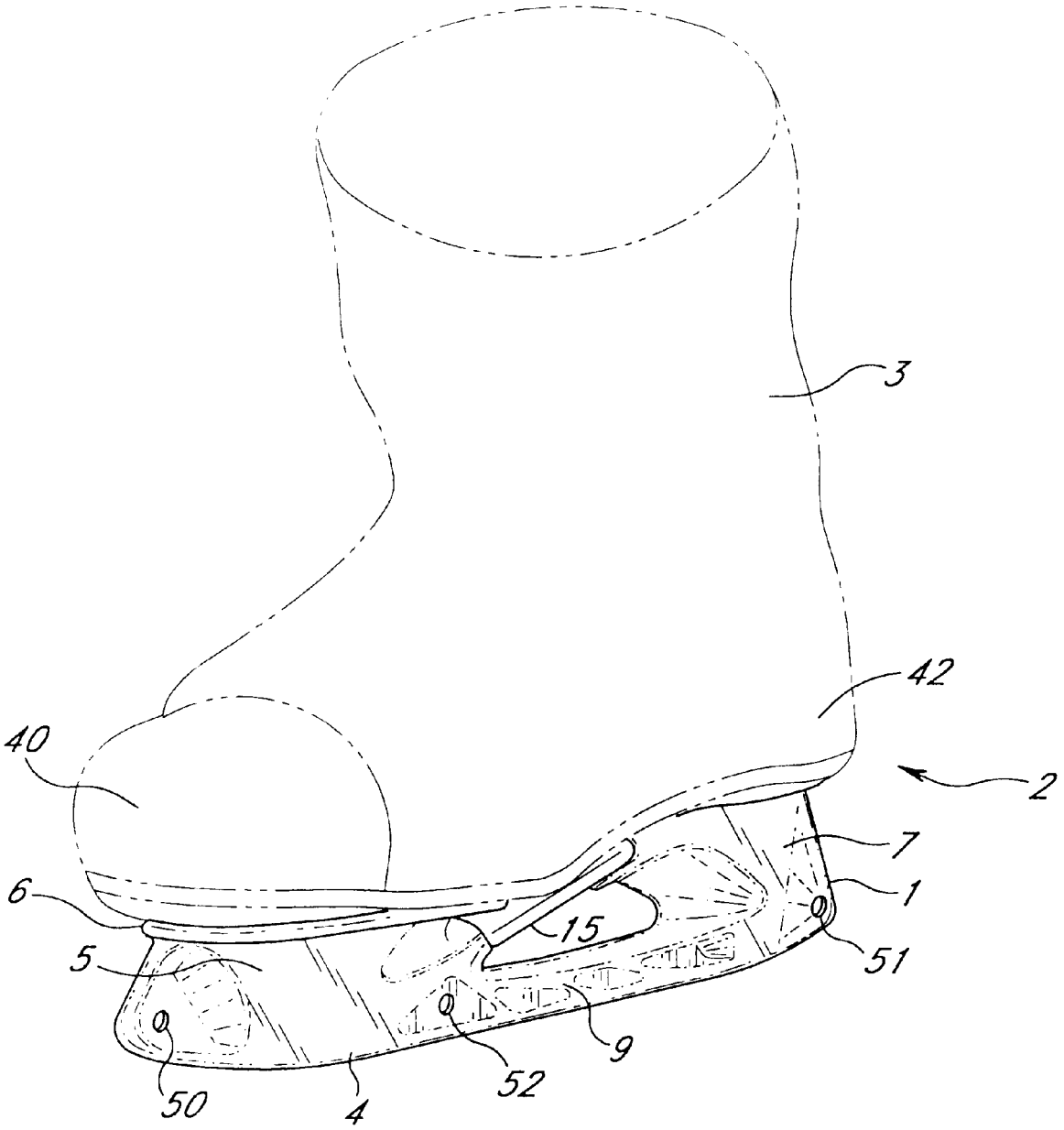
FIG. 1 is a front perspective view of a skate boot and skate blade holder assembly constructed in accordance with a preferred embodiment of the present invention, with the skate boot shown in phantom.

Referring to the accompanying drawings, the skate blade holder assembly 1 is part of a typical skate 2, which also includes a skate boot 3. The skate blade holder assembly includes an elongated blade holder 4 having a front mounting portion 5 with a front pad 6 for attachment beneath the toe area 40 of the boot, a rear mounting portion 7 with a rear pad 8 for attachment beneath the heel area 42 of the skate boot and a "neck" portion 9 between the front and rear mounting portions. A stainless steel or carbon steel blade or "runner" 79 is secured in a longitudinal slot 11 running along the bottom of the blade holder by connectors 65 (see FIG. 7), which pass through holes 70, 71 and 72 in the skate blade and corresponding openings 50, 51 and 52 in the skate blade holder, thereby securing the skate blade 79 to the blade holder 1.

Figure 7:
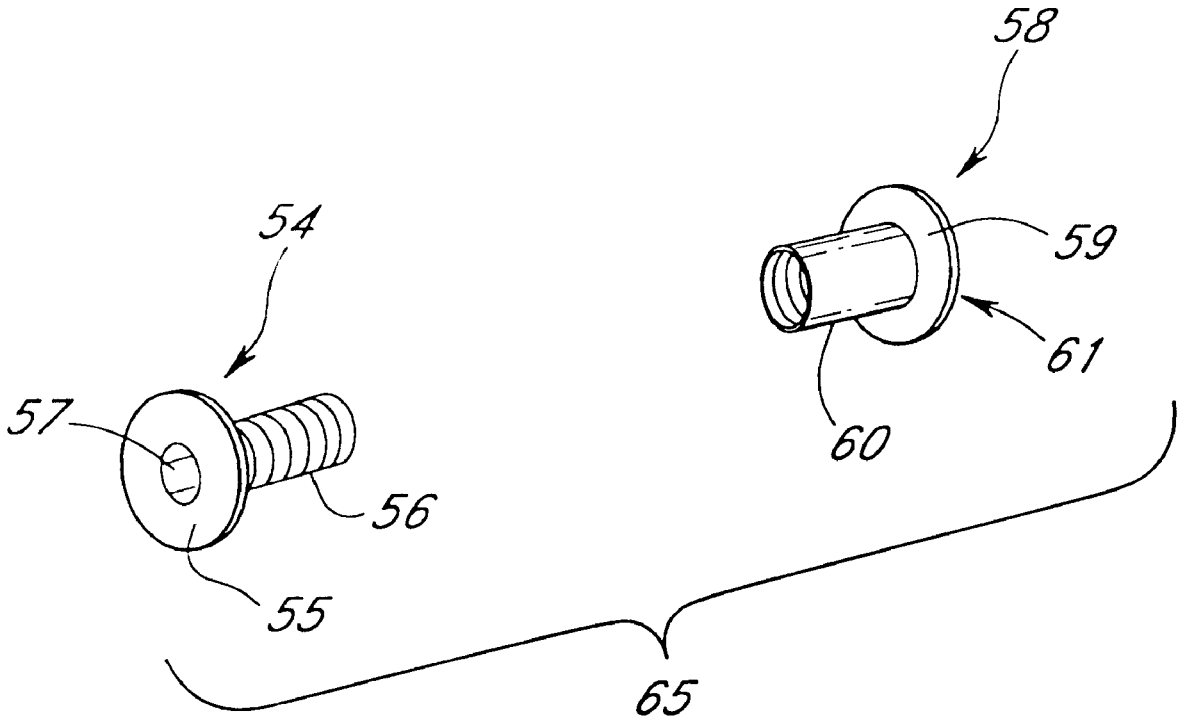
FIG. 7 is an exploded side perspective view of a preferred male/female connector.

As can best be seen in FIG. 7, each connector is desirably a male/female-type connector 65, composed of a male connector portion 54 and a female connector portion 58 which mate together in a manner well known to those of ordinary skill in the art. The male connector portion 54 has a circular head or "anchor" 55, a threaded cylindrical shaft 56 and a hexagonal opening 57 for the insertion of a hexagonal-headed wrench or "hex-wrench" (not shown). The female connector portion 58 has an anchor 59, an internally threaded tubular shaft 60, and a corresponding hexagonal opening 61 (not shown). Alternatively, other suitable connectors well known to those skilled in the art may be used.

Figure 2:
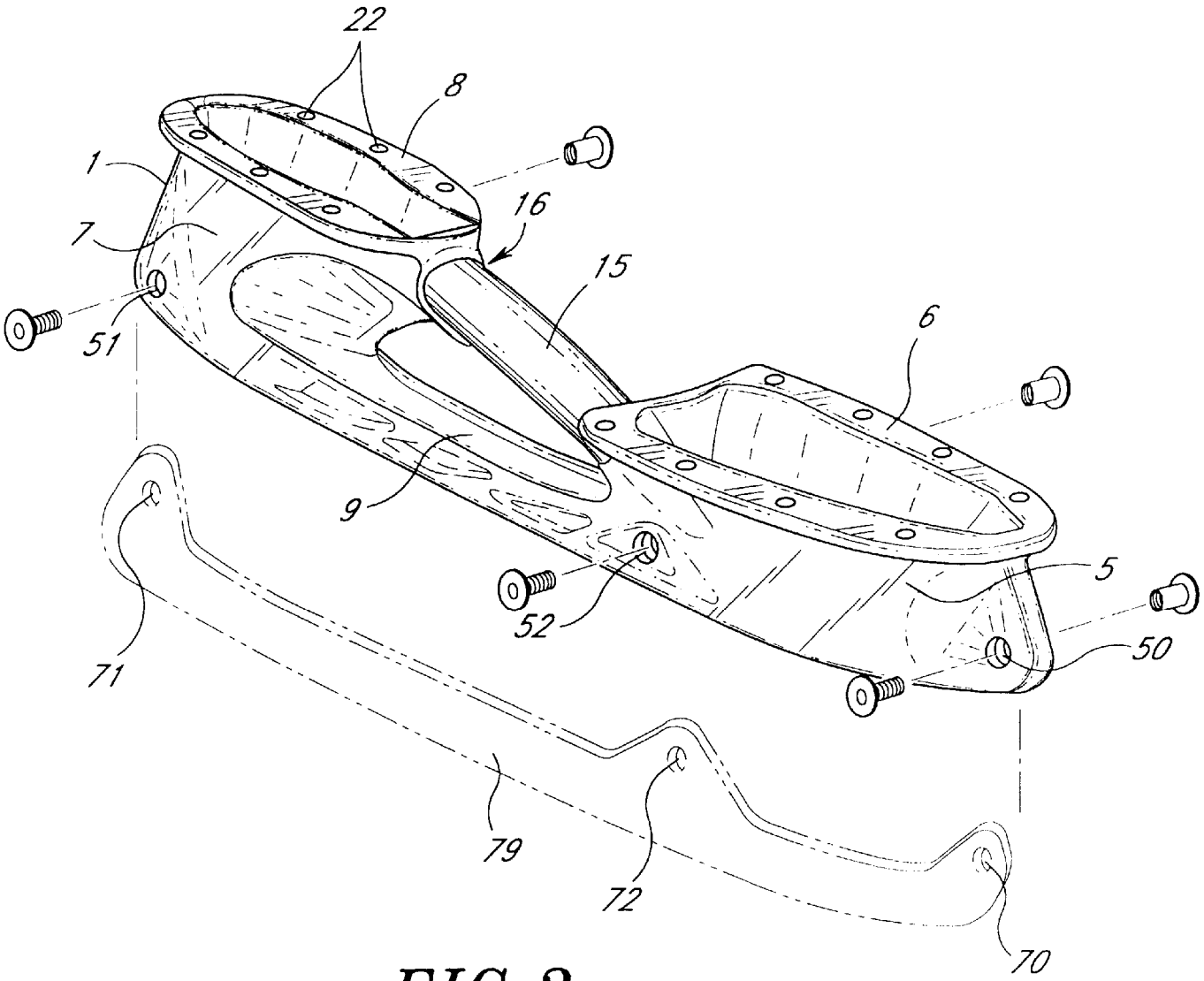
FIG. 2 is an exploded side perspective view of the skate blade holder assembly of FIG. 1.
Figure 3:
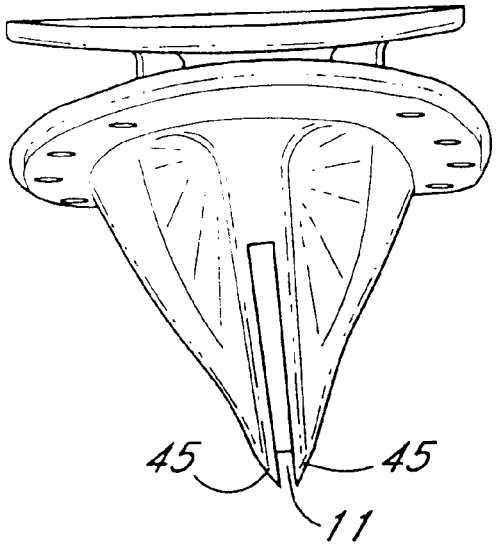
FIG. 3 is a front view of the skate blade holder assembly of FIG. 1.
Figure 4:
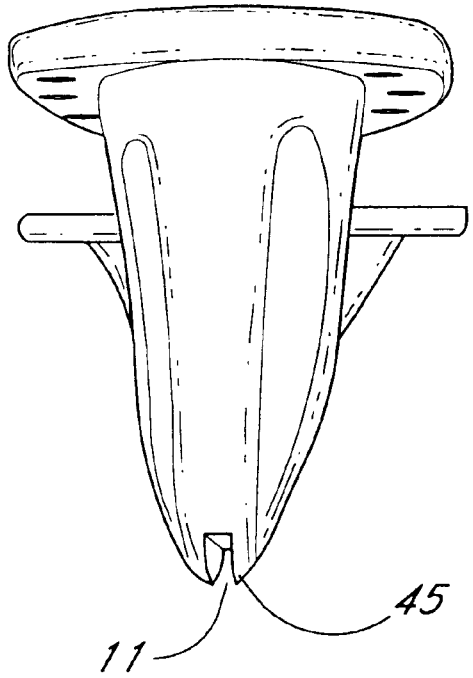
FIG. 4 is a rear view of the skate blade holder assembly of FIG. 1.
Figure 5:
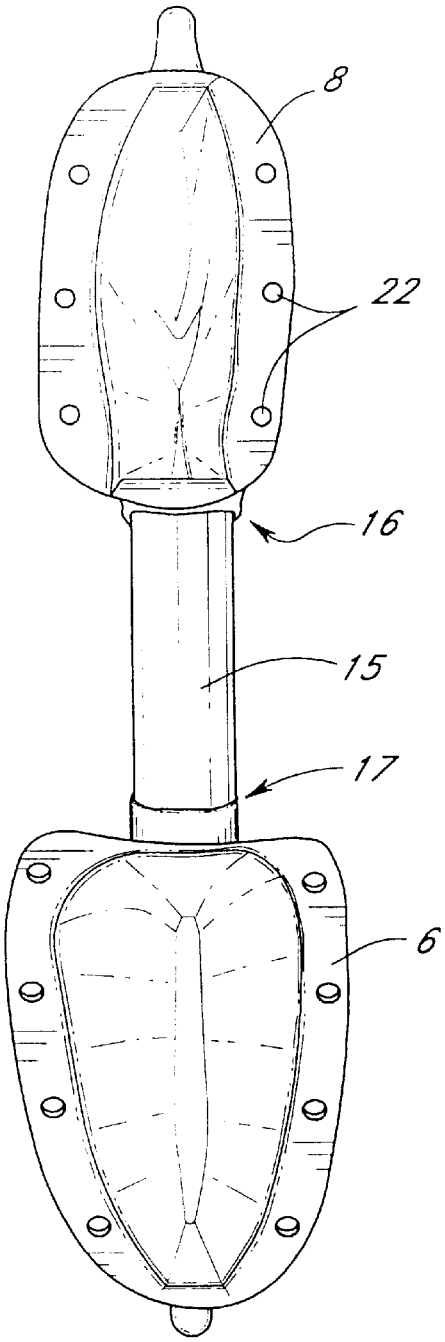
FIG. 5 is a top plan view of the skate blade holder assembly of FIG. 1.
Figure 6:
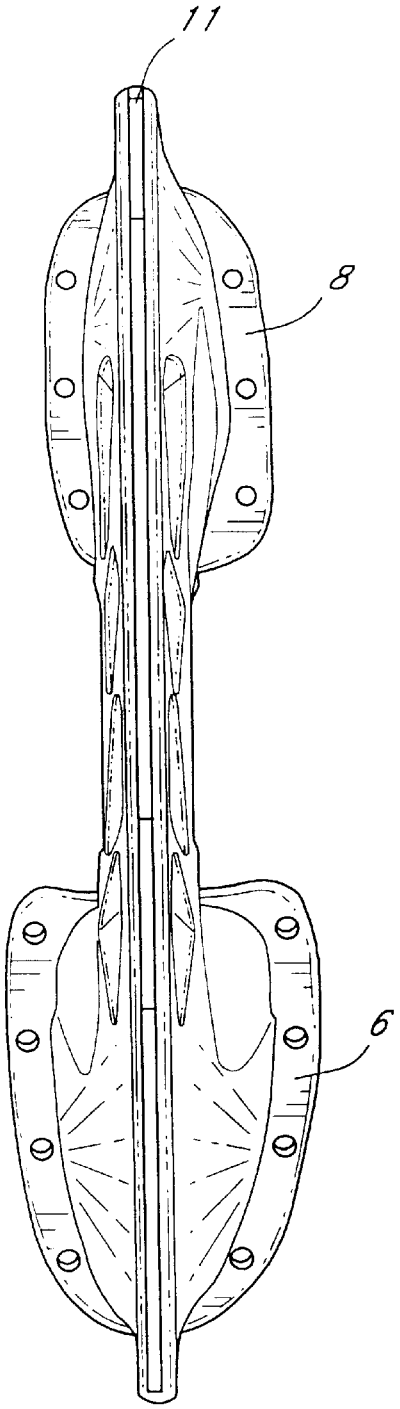
FIG. 6 is a bottom plan view of the skate blade holder assembly of FIG. 1.

Referring now to FIG. 2, to secure the skate blade to the skate blade holder assembly, the skate blade is inserted into the longitudinal slot 11 and positioned such that the openings 70, 71 and 72 in the skate blade are coaxial with the openings 50, 51 and 52 of the blade holder assembly 1. A female connector portion 58 is then inserted into each of the openings 50, 51 and 52 (concurrently passing through the skate blade openings 70, 71 and 72), and a male connector portion 54 is threaded into each of the female connector portions. The connectors are then hand-tightened or hex-wrenches may be inserted into each of the hexagonal openings on a corresponding pair of female/male connectors and tightened by applying opposing torques to the wrenches.

By using a male/female-type connector to connect the skate blade to the blade holder assembly, the present invention minimizes the opportunity for projections on the connector to "catch" on various items in the proximity of the skate blade holder, such as the other skate boot, plants, clothing and/or other skaters. Of course, other types of connectors may be used to secure the skate blade to the blade holder assembly, including but not limited to nut and bolt-type or anchor-type connectors. In addition, other means of applying torque to the connectors could be used, such as the incorporation of a Phillips-head type opening or hexagonal head on the anchor, as well known to those of ordinary skill in the art.

In the preferred embodiment, at least one reinforcement member 15 extends from the front portion 5 to the rear portion 7. The ends of this reinforcement member pass through openings 16 and 17, and are secured to the mounting portions 5 and 7 by a nylon based resin or other such means well known to those skilled in the art. Of course, the reinforcement member may also be secured to the external surface of the mounting portions. In the alternative, the reinforcement member could be formed integrally with the skate blade assembly, if desired, such as by co-extensive injection molding. Conceivably there could be two or more of such reinforcement members, for example, running longitudinally above the neck of the skate blade assembly, if desired.

In a preferred embodiment, the reinforcement member 15 comprises a cylindrical tubular body formed of carbon fibers suspended in a polymer matrix, said matrix typically a heat curable epoxy. Alternatively, a woven, injected plastic composite material such as Zytel™, which is T801 nylon by DuPont, could be used. Of course, a wide variety of other materials such as plastic, fiberglass or metal could also be used.

In order to optimize the strength-to-weight ratio, the reinforcement member is desirably formed in a hollow cylindrical shape of substantially constant diameter, which provides significant strength to support axial and flexural loads. Of course, the reinforcement member could also be formed in virtually any shape including, but not by any way of limitation, ovular, triangular or square cross-sections of constant or varying diameters. A flattened ovular shape is preferred in order to optimize the design for both axial and flexural loads.

Because the reinforcement member structurally connects the front mounting portion to the rear mounting portion, the mounting portions and the reinforcement member essentially form a space frame or "truss" to restrain each other from torsionally twisting under transverse loads. In addition, the reinforcement member substantially limits deformation of the mounting portions along the longitudinal axis of the blade holder, thereby increasing the total rigidity of the skate blade holder assembly under a variety of loading conditions. This increased rigidity reduces blade warpage and provides a better and more efficient force and energy transfer between the ice and the skate boot.

For example, during normal skating, the weight of the skater will be completely supported by the skate blade(s) on the underside of the skate boot(s), and the skate blade will experience a generally uniform vertical compressive force. However, during acceleration, deceleration and/or maneuvering of the skater, the skate blade also experiences significant lateral or "shear" forces along the transverse axis of the skate blade. This lateral force is especially pronounced during acceleration of the skater, when the skater pushes against the ice, using only the front or "toe" portion of the skate blade, in a running-type motion. These compressive and lateral forces tend to: (1) deform the skate blade holder assembly along the longitudinal axis of the blade holder, (2) deform the skate blade holder assembly along the transverse axis of the blade holder, and (3) torsionally twist the front and/or rear blade mounting portions.

In a traditional skate blade holder assembly, in which the front and rear mounting portions are connected only by the neck, the compressive and lateral forces would often predominantly act on one mounting portion, while minimally affecting the other. This would result in a very high stress in the heavily loaded mounting portion, often significantly deforming that section of the skate blade holder assembly.

In a skate blade holder assembly constructed in accordance with the present invention, however, the reinforcing member helps to transfer the load from the more heavily loaded mounting portion to the less heavily loaded one, thereby more evenly distributing the load between the front and rear mounting portions, and reducing the maximum load experienced by either mounting portion. This significantly reduces the amount of deformation experienced in any one portion of the skate blade holder assembly.

Furthermore, in the disclosed embodiment of FIG. 1A, it can be seen that the reinforcement member 15, the rear mounting portion 7 and the neck 9 of the skate blade holder assembly form a triangular "truss." A second triangular "truss" is formed by the reinforcement member 15, the front mounting portion 5 and the skate boot 3 (see FIG. 1). These triangular trusses increase the structural integrity and strength of the skate blade holder assembly along the longitudinal axis of the skate, which greatly increases the overall rigidity and strength of the skate blade holder assembly as compared to the "open frame" support found in a traditional skate blade holder assembly.

Opposing the transverse shear forces, the slot walls 45 extend along a substantial portion of each side of the skate blade and help to stiffen and strengthen the skate blade against plastic deformation and/or failure. When the skate blade experiences shear forces and begins to deform elastically, the deforming skate blade will press against the slot wall and begin to deform the slot wall material. However, because the slot wall material is typically composed of a relatively hard composite-plastic material, the slot wall will resist such deformation, and will assist the skate blade in opposing further deformation of the skate blade.

Moreover, at the front connection point 51 and the rear connection point 50, the interaction between the connectors (not shown) and the deforming slot walls will produce an even greater force opposing lateral deformation of the skate blade. This is because the connectors couple both slot walls to the skate blade, and thus both slot walls will oppose deformation of the skate blade in the connector region, thereby increasing the force opposing deformation of the skate blade.

At the midpoint of a typical blade holder, however, the skate blade is only minimally reinforced. Not only is there traditionally no connector in this region, but the skate holder is usually thinnest along the neck. Accordingly, the skate blade will experience the greatest deformation in this region for a given transverse force. In order to prevent and/or reduce such skate blade deformation, the present invention incorporates a third connector which secures the central section of the skate blade through a central securing opening 52, located in the proximity of the midpoint of the skate blade. This connector couples both slot walls to the skate blade (not shown) along the neck 9 of the skate blade assembly, thereby further reinforcing the skate blade against transverse deformation at or near its most vulnerable location.

The invention has been described with particular reference to a preferred embodiment. Of course, various obvious modifications can be made without departing from the spirit of the invention and such modifications are intended to be within the scope of the following claims, either literally or under the doctrine of equivalents, whether or not expressly described in the above text or illustrated in the accompanying drawings.

I claim:

1. An ice skate blade assembly for attachment to a skate boot, said skate blade assembly comprising:

an elongated blade holder having a front mounting portion with a toe mounting pad for attachment beneath a toe area of the skate boot, a rear mounting portion with a heel mounting pad for attachment beneath a heel area of the skate boot and a neck portion extending between said front and rear mounting portions;

said elongated blade holder having a longitudinal slot for receiving a runner; and a substantially rigid reinforcement member connecting said front mounting portion to said rear mounting portion, said reinforcement member being hollow and being formed as a separate member from said blade holder, said reinforcement member having a rearward end attached to said rear mounting portion at a location substantially directly below a top surface of said heel mounting pad and a forward end attached to a lower end of the forward mounting portion, a single opening being defined between said reinforcement member and said neck portion, the single opening extending substantially along the entire length of the reinforcement member.

2. An ice skate blade holder assembly as in claim 1, wherein the reinforcement member is formed integrally with the blade holder.

3. An ice skate blade holder assembly as in claim 1, wherein the reinforcement member is formed separately from the blade holder.

4. An ice skate blade holder assembly as in claim 3, wherein the front and rear mounting portions each have a receiver portion adapted to receive and support an end of the reinforcement member.

5. An ice skate blade holder assembly as in claim 4, wherein each receiver portion comprises a hole.

6. An ice skate blade holder assembly as in claim 4, wherein the reinforcement member is bonded to the receiver portions using an adhesive.

7. An ice skate blade holder assembly as in claim 1, wherein the front mounting portion, rear mounting portion, and neck portion are coextensively injection molded.

8. An ice skate blade assembly for attachment to a skate boot, said skate blade assembly comprising:

an elongated blade holder having a front mounting portion with a toe mounting pad for attachment beneath a toe area of the skate boot, a rear mounting portion with a heel mounting pad for attachment beneath a heel area of the skate boot and a neck portion extending between said front and rear mounting portions;

said elongated blade holder having a longitudinal slot for receiving a runner; and a substantially rigid reinforcement member connecting said front mounting portion to said rear mounting portion, said reinforcement member being formed as a separate member from said blade holder, said reinforcement member having a rearward end attached to said rear mounting portion at a location substantially directly below a top surface of said heel mounting pad and a forward end attached to a lower end of the forward mounting portion, a single opening being defined between said reinforcement member and said neck portion, the single opening extending substantially along the entire length of the reinforcement member.

9. An ice skate blade holder assembly as in claim 8, wherein the reinforcement member is formed integrally with the blade holder.

10. An ice skate blade holder assembly as in claim 8, wherein the reinforcement member is formed separately from the blade holder.

11. An ice skate blade holder assembly as in claim 8, wherein the reinforcement member has a round or oval cross-section.

12. An ice skate blade holder assembly as in claim 8, wherein the reinforcement member comprises a hollow tubular member.

13. An ice skate blade holder assembly as in claim 8, wherein the reinforcement member is formed separately and is bonded in place.

14. An ice skate blade holder assembly as in claim 8, wherein the front mounting portion, rear mounting portion, and neck portion are injection molded.

15. An ice skate blade assembly for attachment to a skate boot, said skate blade assembly comprising:

an elongated blade holder having a front mounting portion with a toe mounting pad for attachment beneath a toe area of the skate boot, a rear mounting portion with a heel mounting pad for attachment beneath a heel area of the skate boot and a neck portion extending between said front and rear mounting portions;

said elongated blade holder having a longitudinal slot for receiving a runner; and a reinforcement member connecting said front mounting portion to said rear mounting portion, said reinforcement member having a rearward end attached to said rear mounting portion at a location substantially directly below a top surface of said heel mounting pad and a forward end attached to a lower end of the forward mounting portion, a single opening being defined between said reinforcement member and said neck portion, the single opening extending substantially along the entire length of the reinforcement member.

16. An ice skate blade holder assembly as in claim 15, wherein the reinforcement member is formed integrally with the blade holder.

17. An ice skate blade holder assembly as in claim 15, wherein the reinforcement member is formed separately from the blade holder.

18. An ice skate blade holder assembly as in claim 15, wherein the reinforcement member has a round or oval cross-section.

19. An ice skate blade holder assembly as in claim 15, wherein the reinforcement member comprises a hollow tubular member.

20. An ice skate blade holder assembly as in claim 15, wherein the reinforcement member is formed separately and is bonded in place.

21. An ice skate blade holder assembly as in claim 15, wherein the front mounting portion, rear mounting portion, and neck portion are injection molded.

* * * * *